United States Patent [19]

Morizur et al.

[11] Patent Number: 4,526,085

[45] Date of Patent: Jul. 2, 1985

[54] HYDRAULIC LOADING SHOVELS

[75] Inventors: Jean Y. H. Morizur, Compiegne; Victor Yeou, Meau, both of France

[73] Assignee: Poclain, Le Plesses Belleville, France

[21] Appl. No.: 408,017

[22] Filed: Aug. 13, 1982

Related U.S. Application Data

[63] Continuation of Ser. No. 126,126, Feb. 29, 1980, abandoned, which is a continuation-in-part of Ser. No. 808,442, Jun. 21, 1977, abandoned.

[30] Foreign Application Priority Data

Jul. 6, 1976 [FR] France ..... 76 20658

[51] Int. Cl.[3] ..... F01B 25/02

[52] U.S. Cl. ..... 91/6; 91/437; 91/461; 91/520; 91/523; 91/530

[58] Field of Search ..... 91/437, 461, 463, 464, 91/415, 6, 445, 448, 438, 530, 531, 523, 520; 60/547.1, 562, 567, 593

[56] References Cited

U.S. PATENT DOCUMENTS

| | | | |
|---|---|---|---|
| 3,068,596 | 12/1962 | Hein | 91/531 |
| 3,115,716 | 12/1963 | Hein | 37/129 |
| 3,543,645 | 12/1970 | Baatrup | 180/6.3 |
| 3,608,431 | 9/1971 | Pease | 91/437 |
| 3,777,879 | 12/1973 | Dehne | 91/437 |
| 3,916,768 | 11/1975 | Martin | 91/437 |
| 3,922,855 | 12/1975 | Bridwell | 60/421 |
| 3,966,066 | 6/1976 | Schexnayder | 91/531 |

FOREIGN PATENT DOCUMENTS

| | | | |
|---|---|---|---|
| 998917 | 10/1976 | Canada | 91/437 |
| 1176987 | 5/1957 | France | 91/520 |

*Primary Examiner*—Abraham Hershkovitz
*Attorney, Agent, or Firm*—Lewis H. Eslinger

[57] ABSTRACT

The present invention relates to a device for controlling two fluid-controlled drive members, one of which is double-acting, wherein a communication conduit connects the supply conduits of said double-acting drive member, a non-return valve being disposed in said communication conduit and allowing the passage of the fluid solely from the small chamber towards the large chamber of said double-acting drive member, while another conduit is adapted to connect the large chamber of the double-acting drive member to the chamber of the second drive member. The result of the invention is the elimination of lift of a hydraulic loading shovel when digging.

6 Claims, 4 Drawing Figures

12
13
14
42
23
22
41
24
25
26
27
89
88
120
23
63
22
117
65
129
125
128
118
132
126
131
135
127
134
47
87
45
90
130
91
133
92
48
122
64
65
66
67
68
137
123
138
124
136
59
139
57
58
83
84
85
71
79
77
82
76
73
62
69
70
60
75
72
61
74
74
30

HYDRAULIC LOADING SHOVELS

This application is a continuation of our earlier U.S. patent application Ser. No. 126,126, filed Feb. 29, 1980, now abandoned, which is a continuation-in-part of U.S. patent application Ser. No. 808,442 filed June 21, 1977, the disclosure of which is incorporated herein by reference.

The present invention relates to a device for controlling at least two-fluid-controlled drive members.

The use of known, hydraulic loading shovels poses certain problems which, to the present day, have not been solved.

For example, when a shovel is provided with a working attachment comprising two pivotal arms and a bucket, and attempts to penetrate the ground, the members for displacing said shovel are noted to lift with respect to the ground. These lifts are provoked by the reaction of the ground on the working attachment and are due to the relative blocking of the two arms. The effects of these lifts are serious since the shovel deteriorates when it falls back on the ground, there is a reduction in yield of the digging which is either stopped or effected under poor conditions during the lift, and finally, there is an excessive and premature wear of the bucket which is subjected to abnormal stresses.

It is an object of the present invention to remedy this state of affairs by eliminating said lifts. To a certain extent, it is a question of eliminating the blocking of the two arms of the attachment as soon as the beginning of such a lift is detected. Of course, although the invention solves the above-mentioned problem, it consists more generally in proposing a device for controlling at least two drive members, which may or may not be used in a shovel, to oppose the above-mentioned lift or any other hindering effect, and in giving one of these drive members the possibility of an automatic unblocking.

The invention therefore relates to a device for controlling at least two fluid-controlled drive members, at least one of these members, the so-called first drive member, being double-acting and having two distinct chambers, of unequal useful sections, called small and large chambers, constituted by:

at least two main distributors, each being associated with one of said drive members, called first and second main distributor, respectively;

first and second supply conduits each connecting one of the said two chambers of the first drive member to the first main distributor;

at least one main source of pressurized fluid;

conduits connecting a main source to each distributor.

The first distributor comprises first, second and third positions, in which said first position the small chamber of the first drive member communicates with said main source, in the second position the two chambers are isolated and in the third position the large chamber communicates with said main source. Moreover, the second drive member comprises at least one chamber connected to the second main distributor by a supply conduit, this second main distributor comprising at least two positions, and in its first and second positions, respectively, placing said chamber of the second drive member in communication with a main source and isolating this chamber from this main source. A communication conduit connects the first and second supply conduits of the first drive member, a non-return valve being disposed in this communication conduit and allowing the passage of the fluid solely from the small chamber towards the large chamber of this first drive member. The non-return valve lifts from its seat at a very low pressure differential of less than 5 to 10 bars.

A conduit may connect the large chamber of the first drive member to said chamber of the second drive member.

The device also preferably comprises a two-position selector, which is disposed in said communication conduit and which, in its first position, ensures the continuity of this communication conduit, whilst, in its second position, it obturates said communication conduit.

When the supplies of the said two drive members are effected according to one of the two known types of circuits, parallel and independent, a two-way distributor is disposed in the supply circuit of the large chamber of the first drive member, is connected, via a by-pass conduit, to the supply conduit of said chamber of the second drive member, interrupts, in its first position, said supply conduit of the large chamber of the first drive member, placing that part of this conduit connected to said large chamber in communication with the by-pass conduit, ensures, in its second position, the continuity of the supply conduit of the large chamber of the first drive member and comprises a device for adjusting its position which is combined with the devices for adjusting the position of the first and second main distributors, so that these three distributors are concomitantly placed either in their respective first positions or in their respective second positions.

The invention will be more readily understood on reading the following description with reference to the accompanying drawings, in which.

Figure 1:
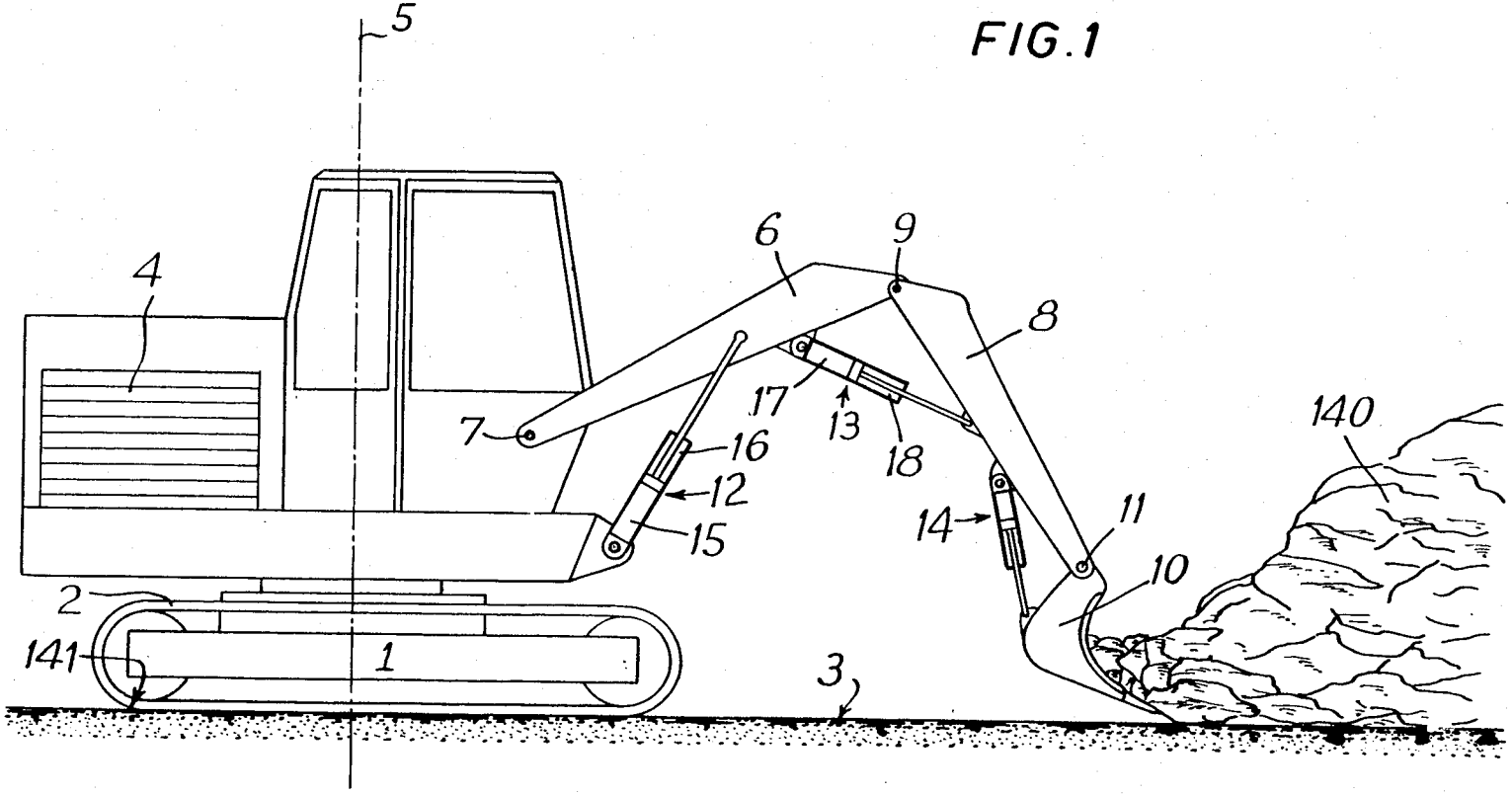
FIG. 1 is an elevation view of a hydraulic loading shovel comprising a device for controlling its working attachment according to the invention.

Referring now to the drawings, FIG. 1 shows a loader which comprises a chassis 1, provided with endless tracks 2, by which it is supported on the ground 3. A turret 4 is mounted to pivot on the chassis 1 about a vertical axis 5. A jib 6 is pivoted on the turret 4 about a horizontal axis 7, whilst a balance beam 8 is itself pivoted on the jib 6 about an axis 9 parallel to axis 7, and a bucket 10 is pivoted on the balance beam 8 about an axis 11 parallel to axis 7. A jack 12 is coupled between the turret 4 and the jib 6, a jack 13 being coupled between the jib 6 and the balance beam 8 and a jack 14 being coupled between the balance beam 8 and the bucket 10.

It will be expedient to distinguish the chambers of the jacks 12 and 13 and to note that the supply of the large chamber 15 of the jack 12 corresponds to the rise of the jib 6, the supply of the small chamber 16 of said jack corresponding, on the contrary, to the lowering of the jib 6, in the same way as the supply of the large chamber 17 of the jack 13 corresponds to the extension of the balance beam 8 with respect to the jib 6, the supply of the small chamber 18 of the jack 13 corresponding, on the contrary, to the return of the balance beam 8 beneath the jib 6.

Figure 2:
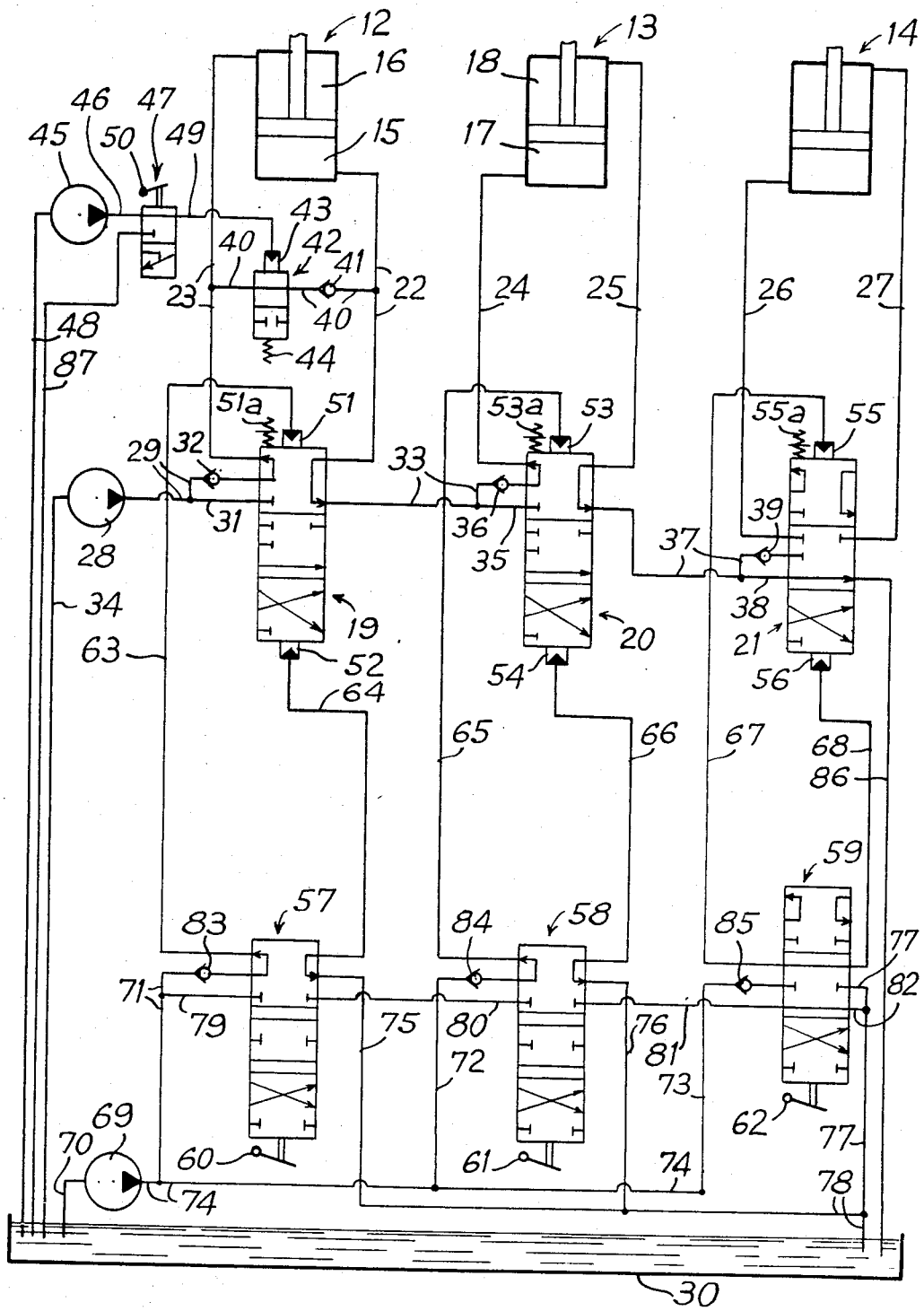
FIG. 2 is a diagram of the device for controlling the working attachment of the loader of FIG. 1, in a "series" type distribution.

The circuit shown in FIG. 2 represents a "series" type distribution of fluid, and comprises:

three main three-way distributors 19, 20, 21 for controlling the jacks 12, 13 and 14, respectively, three groups of two supply conduits 22-23, 24-25 and 26-27, respectively, connecting the large and small chambers of jacks 12, 13, 14 to the corresponding distributor, a main pump 28, whose delivery conduit 29 is connected to the main distributor 19 and whose suction conduit 34 is connected to a fluid tank 30, a conduit 31 which connects the conduit 29 to the distributor 19, a non-return valve 32 disposed in that part of the delivery conduit 29 included between the distributor 19 and the connection of conduit 31 to the conduit 29, a conduit 33, which connects the main distributors 19 and 20, a conduit 35 which connects conduit 33 to the main distributor 20, a non-return valve 36 disposed in that part of the conduit 33 included between the distributor 20 and the connection of conduit 36 to conduit 33, a conduit 37 which connects the main distributors 20 and 21, a conduit 38 which connects conduit 37 to main distributor 21, a non-return valve 39 disposed in that part of the conduit included between the distributor 21 and the connection of conduit 38 to conduit 37, said non-return valves 32, 36, 39 allowing the passage of the fluid towards distributors 19, 20, 21, respectively.

a communication conduit 40, which connects the conduits 23 and 22, a non-return valve 41 disposed in conduit 40 and allowing the passage of the fluid from conduit 23 towards conduit 22, a two-position selector 42, also disposed in the communication conduit 40, coupled to a control jack 43 and a return spring 44 having antagonistic effects, the spring tending to place the selector in the second position, which will be defined hereinafter, a service pump 45 connected, via its delivery conduit 46, to a two-way distributor 47, and via its suction conduit 48, to tank 30, a conduit 49 connecting the jack 43 to the two-way distributor 47, a voluntary control 50, for example manual, of the distributor 47, control jacks 51-52, 53-54, 55-56, coupled in pairs to the main distributors 19, 20, 21, respectively, the jacks of each pair having antagonistic effects and the jacks 51, 53 and 55 having an effect tending to place the corresponding distributors 19, 20, 21, respectively, into its first position, which will be defined hereinafter, whilst springs 51*a*, 53*a*, 55*a* are also coupled to the main distributors 19, 20, 21 and have for their effect to place these distributors in their second position, when the effects of the jacks of each pair of jacks 51-51, 53-54, 55-56, respectively, are mutually annulled.

three so-called auxiliary three-way distributors 57, 58, 59 which correspond to the main distributors 19, 20, 21, and which are provided with voluntary controls 60, 61, 62, respectively, three pairs of conduits 63-64, 65-66, 67-68 which connect the jacks 51-52, 53-54, 55-56 to the auxiliary distributors 57, 58, 59, respectively, another service pump 69, whose suction conduit 70 is connected to the tank 30, conduits 71, 72, 73, which connect the distributors 57, 58, 59 to the delivery conduit 74 of the pump 69, respectively, conduits 75, 76, 77, which connect the distributors 57, 58, 59 to a conduit 78 connected to tank 30, a conduit 79 connecting the conduit 71 to distributor 57, a conduit 80 connecting distributors 57 and 58, a conduit 81 connecting distributors 58 and 59, a conduit 82 connecting the distributor 59 to conduit 77, non-return valves 83, 84, 85 disposed in conduits 71, 72, 73 so as to allow passage of the fluid in these conduits towards the auxiliary distributors 57, 58, 59, respectively.

The positions of the various distributors and of the selector 42 remain to be defined.

The three positions of the main distributor 19 correspond as follows:

the first position corresponds to the communicating of conduits 23 and 29 and of conduits 22 and 33, and to the obturating of conduit 31, the second position, to the communicating of conduits 31 and 33 and to the obturating of conduits 22, 23 and 29, and the third position, to the communicating of conduits 23 and 33 and of conduits 22 and 29, and to the obturating of conduit 31.

In FIG. 2, the distributor is placed in its first position further to the predominant effect of jack 51.

The three positions of the main distributor 20 corresponds as follows:

the first position corresponds to the communicating of conduits 24 and 33 and of conduits 25 and 37, and to the obturating of conduit 35.

the second position, to the communicating of conduits 35 and 37 and to the obturating of conduits 24, 25 and 33, and the third position, to the communicating of conduits 24 and 37 and of conduits 25 and 33, and to the obturating of conduit 35.

The position of the distributor 20 shown in FIG. 2 is the first position, further to the predominant effect of jack 53.

The three positions of the main distributor 21 corresponds as follows:

the first position corresponds to the communicating of conduits 26 and 37 and of conduits 27 and 86, this conduit 86 connecting the distributor 21 to tank 30, and to the obturating of conduit 38, the second position, in which the distributor 21 is placed in FIG. 2, to the communicating of conduits 38 and 86, and to the obturating of conduits 26, 27 and 37, and the third position, to the communicating of conduits 26 and 86 of conduits 27 and 37 and to the obturating of conduit 38.

The respective first, second or third positions of the auxiliary distributors 57, 58, 59 and of the main distributors 19, 20, 21 correspond to one another.

In this way, auxiliary distributors 57 and 58 are placed in their first respective positions, which will now be defined, auxiliary distributor 59 being in its second position.

The three positions of the auxiliary distributor 57 now correspond as follows:

the first position corresponds to the communicating of conduits 63 and 71 and of conduits 64 and 75, and to the obturating of conduits 79 and 80.

the second position, to the communicating of conduits 63 and 64 and of conduits 79 and 80, and to the obturating of conduits 71 and 75, and the third position, to the communicating of conduits 63 and 75 of conduits 64 and 71 and to the obturating of conduits 79 and 80.

The three positions of the auxiliary distributor 58 corresponds as follows:

the first position corresponds to the communicating of conduits 65 and 72 and of conduits 66 and 76, and to the obturating of conduits 80 and 81.

the second position, to the communicating of conduits 65 and 66, and of conduits 80 and 81, and to the obturating of conduits 72 and 76, and the third position, to the communicating of conduits 65 and 76 and of conduits 66 and 72, and to the obturating of conduits 80 and 81.

The three positions of the distributor 59 correspond as follows:

the first position corresponds to the communicating of conduits 67 and 73 and of conduits 68 and 77, and to the obturating of conduits 81 and 82.

the second position, to the communicating of conduits 67 and 68 and of conduits 81 and 82, and to the obturating of conduits 73 and 77, and the third position, to the communicating of conduits 67 and 77 and of conduits 68 and 73, and to the obturating of conduits 81 and 82.

The respective positions of the selector 42 and of the distributor 47 correspond to one another, the first positions being shown in FIG. 2.

The positions of the selector 42 correspond as follows:

the first position corresponds to the continuity of the conduit 40 and to the preponderance of the action of jack 43, and the second position, to the cut of conduit 40 and the preponderance of the action of spring 44.

The positions of the distributor 47 correspond as follows:

the first position corresponds to the communicating of conduits 46 and 49, and to the obturating of a conduit 87 connecting distributor 47 to the tank 30, and the second position, to the communicating of conduits 46, 49 and 87.

Figure 3:
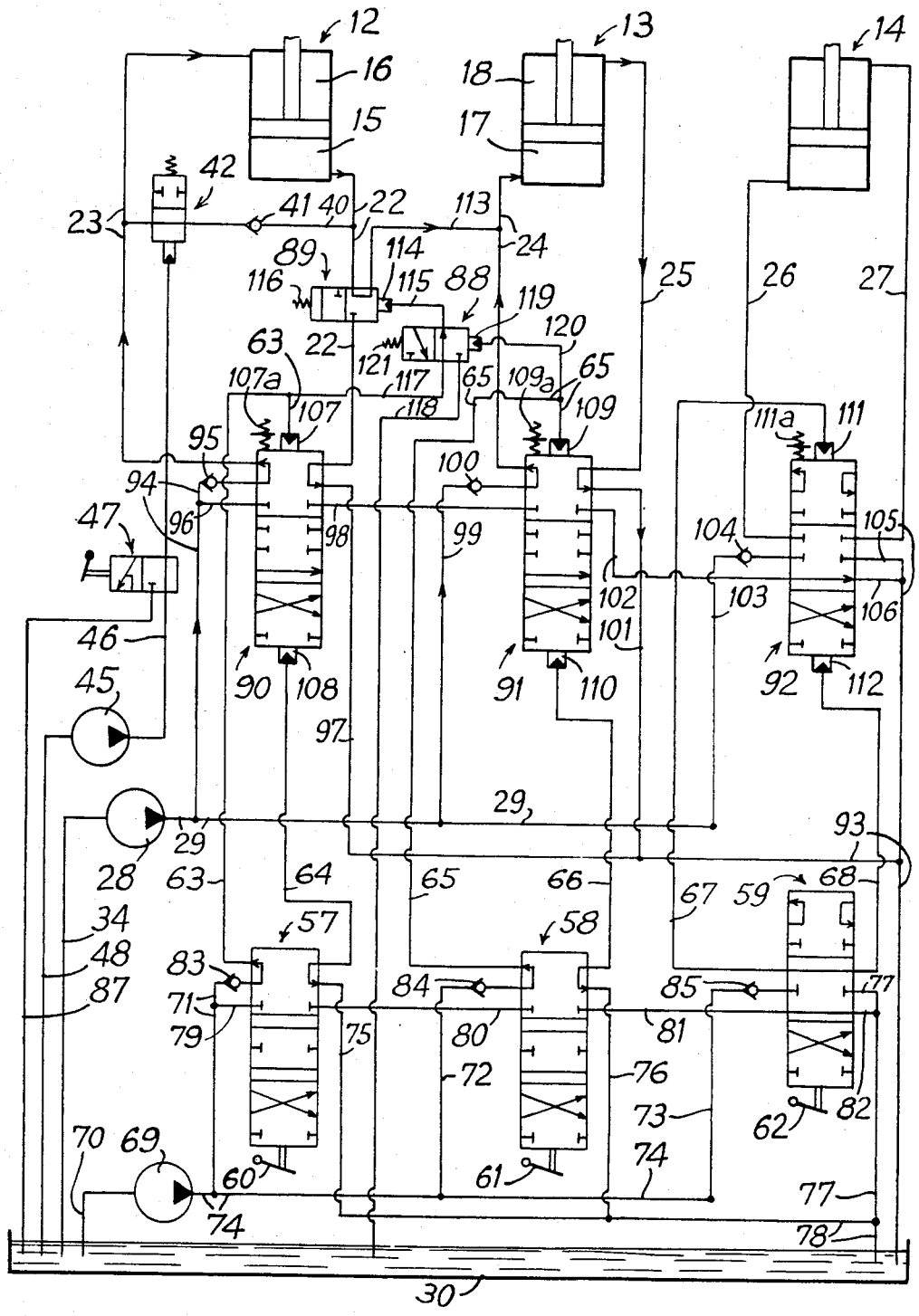
FIG. 3 is a diagram of the device for controlling the working attachment of the loader of FIG. 1 in a "parallel" type distribution.

The circuit of FIG. 3 shows a "parallel" type distribution of fluid to the jacks 12, 13 and 14. It comprises numerous elements which have already been defined in FIG. 2 and which have retained the same references. The main distributors and their connections are different, and two automatic two-way selectors 88 and 89 and their connection have been added. All these elements will now be described.

The new main distributors 90, 91, 92 correspond to the main jacks 12, 13, 14 and to the auxiliary distributors 57, 58, 59.

The following conduits are connected to distributor 90:

22 and 23, which have already been defined,

94, which is also connected to the delivery conduit 29 of the pump 28, and in which is disposed a non-return valve 95, allowing passage of the fluid towards distributor 90,

96, also connected to conduit 94, between the non-return valve 95 and the delivery conduit 29,

97, connected to a conduit 93 connected to tank 30,

98, also connected to the auxiliary distributor 91.

The following conduits are connected to the auxiliary distributor 91:

24, 25 and 98, which have already been defined,

99, which is also connected to the delivery conduit 29, and on which is disposed a non-return valve 100 allowing passage of the fluid towards the distributor 91,

101, connected to conduit 93,

102, connected to the distributor 92.

The following conduits are connected to the auxiliary distributor 92:

26, 27 and 102, which have already been defined,

103, which is connected to the delivery conduit 29 and in which a non-return valve 104 is disposed and allows passage of the fluid towards the distributor 92.

105, connected to conduit 93,

106, connected to conduit 105.

The main distributors 90 and 91 are in first positions which will be defined hereinafter and which correspond to the first positions of the auxiliary distributors 57 and 58. Similarly, the main distributor 92 is in a second position, which will be defined hereinafter and which corresponds to the second position of the auxiliary distributor 59. Generally, it must be noted that the respective positions of the main distributors 90, 91 and 92 and of the auxiliary distributors 57, 58 and 59 correspond to one another.

It is noted that the jacks are coupled in pairs 107-108, 109-110, 111-112 to the main distributors 90, 91, 92, respectively, the jacks of each pair having an antagonistic effect, and the jacks 107, 109, 111 having an effect tending to place the corresponding distributor in its first position. Conduits 63, 64, 65, 66, 67 and 68, which have already been defined, are connected to said jacks 107, 108, 109, 110, 111 and 112, respectively. Springs **107*a*, 109*a*, 111*a* are also coupled to the main distributors 90, 91, 92 and have for their effect to place these distributors in their second position, when the effects of the jacks of each pair of jacks 107-108, 109-110, 111-112**, respectively, are mutually annulled.

The selector 89 is disposed in conduit 22 beyond the connection of conduits 22 and 40 with respect to the chamber 15 of jack 12 and is connected to conduit 24 via a conduit 113. It is coupled to a jack 114 connected to the selector 88 by a conduit 115, and to a spring 116, whose effect is opposed to that of the jack 114 and tending to place said selector 89 in its second position.

The selector 88 is connected, by a conduit 117, to conduit 63 and, by a conduit 118, to tank 30. It is coupled to a jack 119 connected to conduit a 65 by a conduit 120 and to a spring 121 whose effect is opposed to that of the jack 119 and tending to place this selector 88 in its first position.

The various positions of the main distributors 90, 91, 92 and of the selectors 88 and 89 will now be defined.

The three positions of the main distributor 90 correspond as follows:

the first position corresponds to the communicating of conduits 23 and 94 and of conduits 22 and 97, and to the obturating of conduits 96 and 98, the second position, to the communicating of conduits 96 and 98, and to the obturating of conduits 22, 23, 94 and 97, and the third position to the communicating of conduits 22 and 94 and of conduits 23 and 97, and to the obturating of conduits 96 and 98.

The three positions of the main distributor 91 correspond as follows:

the first position corresponds to the communicating of conduits 24 and 99 and of conduits 25 and 101, and to the obturating of conduits 98 and 102, the second position, to the communicating of conduits 98 and 102, and to the obturating of conduits 24, 25, 99 and 101, and the third position, to the communicating of conduits 24 and 101 and of conduits 25 and 99, and to the obturating of conduits 98 and 102.

The three positions of the main distributor 92 correspond as follows:

the first position corresponds to the communicating of conduits 26 and 103 and of conduits 27 and 105, and to the obturating of conduits 102 and 106, the second position, to the communicating of conduits 102 and 106, and to the obturating of conduits 26, 27, 103 and 105, and the third position, to the communicating of conduits 26 and 105 and of conduits 27 and 103, and to the obturating of conduits 102 and 106.

The two positions of the selector 88 correspond as follows:

the first position corresponds to the communicating of conduits 115 and 118, and to the obturating of conduit 117, and the second position to the communicating of conduits 115 and 117, and to the obturating of conduit 118.

The two positions of the selector 89 correspond as follows:

the first position corresponds to the cutting of conduit 22, the communicating of that part of said conduit 22 which is connected to chamber 15 of the jack 12, with conduit 113, and to the obturating of the other part of conduit 22, and the second position, to the maintaining of the continuity of conduit 22, and to the obturating of conduit 113.

Figure 4:
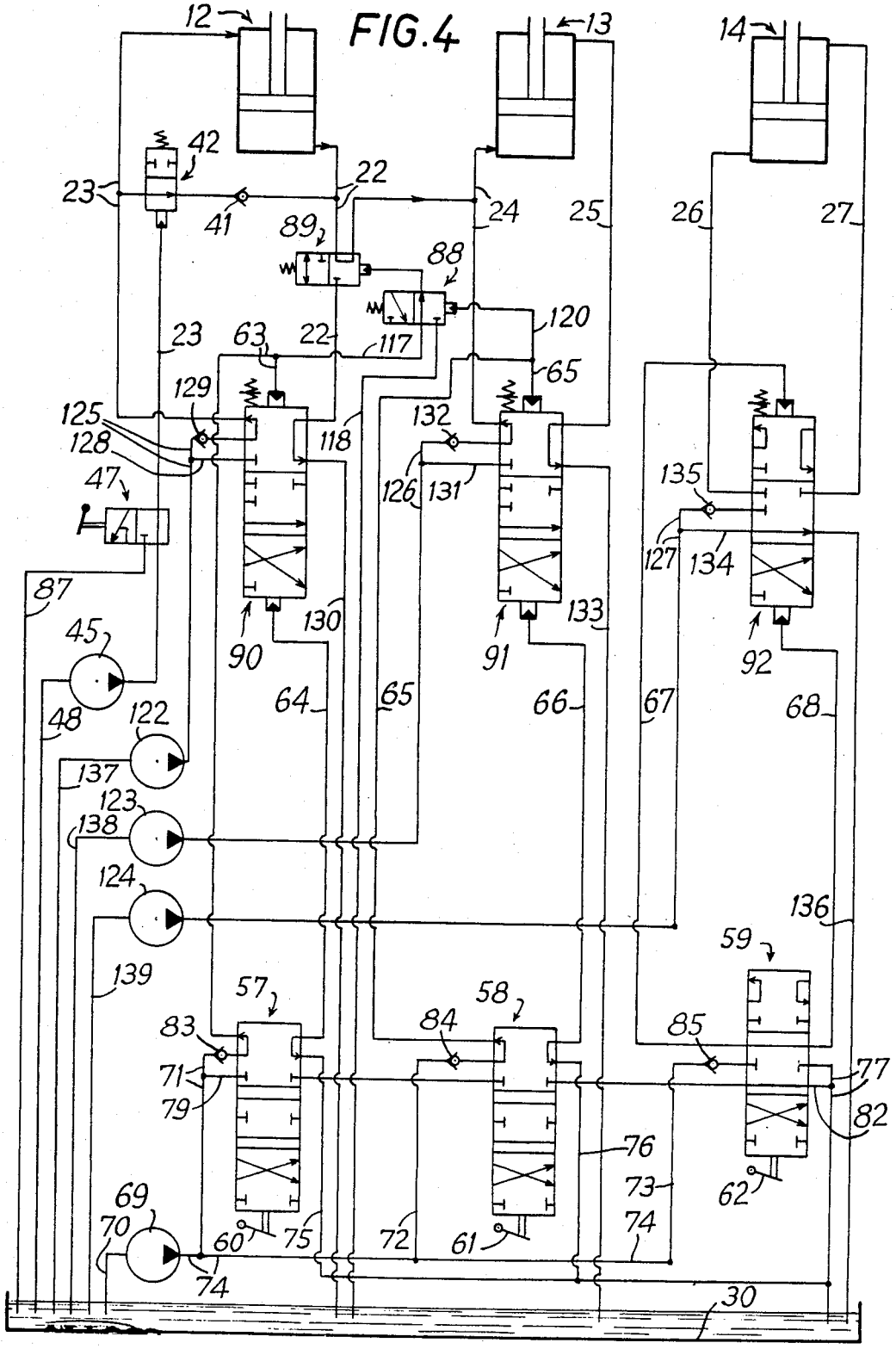
FIG. 4 is a diagram of the device for controlling the working attachment of the loader of FIG. 1, in an "independent" type distribution.

Finally, the circuit of FIG. 4 shows an "independent" type distribution of fluid to jacks 12, 13, 14. It comprises virtually all the elements which have already been defined with reference to FIG. 3, which have, of course, retained the same references. The connections of the main distributors 90, 91, 92 are different, their being each connected independently to pumps 122, 123, 124 by the delivery conduits 125, 126, 127 of these latter, respectively.

The following conduits are connected to the main distributor 90:

22, 23 and 125, which have already been defined,

128, which is connected to conduit 125 between a non-return valve 129, disposed in this conduit 125 so as to allow the passage of fluid towards the distributor 90, and pump 122,

130, connected to tank 30.

The following conduits are connected to the main distributor 91:

24, 25, 126, which have already been defined,

131, which is connected to conduit 126 between a non-return valve 132, disposed in this conduit 126 so as to allow the passage of the fluid towards the distributor 91, and pump 123,

133, connected to tank 30.

The following conduits are connected to the main distributor 92:

26, 27 and 127, which have already been defined,

134, which is connected to the conduit 127 between a non-return valve 135, disposed in this conduit 127 so as to allow the passage of the fluid towards the distributor 92, and pump 124.,

136, connected to tank 30.

Of course, the pumps 122, 123, 124 are connected to tank 30 by their respective suction conduits 137, 138 and 139.

The positions of the main distributors 90, 91 and 92, of FIG. 4, will now be specified.

The three positions of the main distributor 90 correspond as follows:

the first position corresponds to the communicating of conduits 23 and 125 and of conduits 22 and 130, and to the obturating of conduit 128;

the second position, to the communicating of conduits 128 and 130, and to the obturating of conduits 22, 23 and 125, and the third position, to the communicating of conduits 23 and 130 and of conduits 22 and 125, and to the obturating of conduit 128.

The three positions of the main distributor 91 correspond as follows:

the first position corresponds to the communicating of conduits 24 and 126 and of conduits 25 and 133, and to the obturating of conduit 131, the second position, to the communicating of conduits 131 and 133, and to the obturating of conduits 24, 25 and 126, and the third position, to the communicating of conduits 24 and 133 and of conduits 25 and 126, and to the obturating of conduit 131.

The three positions of the distributor 92 correspond as follows:

the first position corresponds to the communicating of conduits 26 and 127 and of conduits 27 and 136, and to the obturating of conduit 134, the second position, to the communicating of conduits 134 and 136, and to the obturating of conduits 26, 27, 127, and the third position to the communicating of conduits 26 and 136 and of conduits 27 and 127, and to the obturating of conduit 134.

The functioning of the circuits of FIGS. 2, 3 and 4 will now be set forth.

The machine of FIG. 1 will firstly be studied and it will be assumed that it is equipped with the circuit of FIG. 2 except for conduit 40, non-return valve 41 and selector 42.

The driver wishes to load the bucket 10 and, placing the auxiliary distributors 57 and 58 in their first position, thus the main distributors 19 and 20 also in their first position, supplies the small chamber 16 of jack 12 and the large chamber 17 of jack 13 with pressurized fluid. The jib 6 is lowered whilst the balance beam 8 tends to extend so that the bucket 10 penetrates into the heap of material 140. The following undesirable reactions may occur which may all cause the chassis 1 to tip about the line of contact 141 of the rear parts of the endless tracks 2:

the bucket 10 rests on the ground 3 and transmits to the balance beam then to jib a reaction which causes the front part of the endless tracts 2 to lift;

the bucket 10 attempts to penetrate into the heap 140, is stopped by an excessive resistance of the material, and also transmits a reaction causing the front part of the endless tracks 2 to lift.

Other reactions may also cause the chassis 1 to lift, as the man skilled in the art is aware.

If, on the contrary, the loading shovel is provided with the improved circuit of FIG. 2, comprising the conduit 40, non-return valve 41 and selector 42, there is no risk of lift. The non-return valve 41 is responsive to very small—almost nil—pressure differentials, e.g. of less than 5 to 10 bars. This is to be distinguished therefore from a conventional check valve which operates at pressure differentials of from 300 to 400 bars or higher.

In fact, at the beginning of a lift, the small chamber 16 of jack 12 and the large chamber 17 of jack 13 contain a fluid under pressure. If the selector 42 is placed in its first position, the fluid of the small chamber 16 may, by passing through said selector 42 and the non-return valve 41, arrive in the large chamber 15 of jack 12. In view of the difference in the sections of said chambers 15 and 16, the effect of the fluid is to push the piston in the direction increasing the volume of the large chamber 15, and thus to lift the jib, this stopping the beginning of lift of the chassis 1. An automatic, anti-lift unblocking of the jib has been effected.

The maneuver of the balance beam 8, which would risk causing the chassis 1 to lift, is effected when the large chamber 17 of jack 13 is supplied with pressurized fluid. In view of the fact that, in the "series" type distribution of FIG. 2, the chamber 17 is supplied only by the fluid delivered from chamber 15, and that the said two chambers are then in communication, there again, the fluid of chamber 17 may arrive in chamber 15 and raise the jib to eliminate the risk of lift, the fluid of chamber 16 still being able to pass through the non-return valve 41 to escape from said chamber.

In all described cases of the circuit of FIG. 2, there is no more risk of lift.

However, for repairing an endless track, for example, or for its maintenance, it may be desired to lift the chassis 1 by supporting it on the working attachment. This is possible. If suffices to place the distributor 47 in its second position. The jack 43 of the selector 42 then communicates with the tank 30 by conduits 49 and 87, so that the spring 44 places said selector 42 in its second position. The conduit 40 is interrupted and, as the chambers 15 and 16 can no longer communicate, the jack 12 remains blocked, this enabling the chassis 1 tyo be lifted, if required.

In the case of a "parallel" type distribution circuit, such as that of FIG. 3, there is no longer any direct connection of the supply of the large chambers 15 and 17 of jacks 12 and 13. Thus, the circuit of FIG. 2 must be completed in order to establish such a connection artificially. This is the purpose of the selectors 88 and 89 and their connections. In this way, when the lowering of the jib 6 and extension of the balance beam 8 are controlled, by placing the auxiliary distributors 57 and 58 in their first position, the jacks 107 and 109 are supplied with pressurized fluid. The fluid of jack 109 pushes the selector 88 into its second position, this enabling the fluid of jack 107, via conduits 117 and 115, to arrive in jack 114 which places the selector 89 in its first position. By conduits 22 and 113, the connection is established between chambers 15 and 17, and the functioning is the same as has already been explained with reference to FIG. 2, both concerning the non-lift of the chassis and the exceptional neutralisation of this non-lift.

There is little to say concerning the circuit of FIG. 4, except to specify that it functions in exactly the same manner as that of FIG. 3, concerning the feature of non-lift and neutralisation thereof. The only known difference beween the two circuits is the difference distinguishing the "parallel" type distribution from the "independent" type distribution, which are both known.

The following points may finally be made:

although the circuit of FIG. 2 does not necessitate the presence of selectors 88 and 89 and their connections, it may, however, perfectly well integrate these elements which, although superfluous, do not cause any hindrance;

in the circuits of FIGS. 3 and 4, the direct connection via conduits 22 and 113 between chamers 15 and 17 is made by obtaining information from the supplies of chambers 16 and 17 from the pressure in jacks 107 and 109. Of course, the use of this information is given only by way of example and it is understood that the positioning of the selector 89 in its first position, which must correspond to the first positions of the main distributors 90 and 91, may be controlled by any device other than that shown. Any electronic or mechanical synchronisation device may thus replace the selector 88 and jack 114.

What is claimed is:

1. A device for controlling at least first and second fluid-controlled drive members wherein the first drive member is double-acting and has separate small and large chambers of unequal useful sections, including:

first and second main distributors respectively associated with said first and second drive members, first and second supply conduits each respectively connecting one of said small and large chambers of the first drive member to the first main distributor, at least one main source of pressurized fluid, a plurality of conduits connecting said main source to each distributor, said first distributor being movable to first, second, and third positions, in which in said first position the small chamber of the first drive member communicates with the main source associated therewith, in the second position the two chambers of said first drive member are isolated, and in the third position the large chamber communicates with said main source, said second drive member having at least one chamber, a supply conduit connecting said one chamber to the second main distributor, said second main distributor being movable to at least first and second positions respectively placing said chamber of the second drive member in communication with said main source and isolating that chamber from said main source, a communication conduit connecting the first and second supply conduits of the first drive member and non-return valve means disposed in said communication conduit for allowing the passage through the communication conduit of fluid only from the small chamber towards the large chamber of this first drive member in response to extremely low pressure differentials, and preventing passage of fluid from the large chamber towards the small chamber of the first drive member through the communication conduit, a two-position selector disposed in said communication conduit and which, in a first position ensures the continuity of this communication conduit, and in a second position obturates said communication conduit to flow of fluid in either direction therein, and a two-way distributor disposed in the supply conduit of the large chamber of the first drive member and connected, via a by-pass conduit to the supply conduit of said chamber of the second drive member, said two-way distributor being movable between first and second positions and interrupting, in its first position, said supply conduit of the large chamber of the first drive member, placing that part of the supply conduit connected to said large chamber in communication with the by-pass conduit and ensuring, in its second position, the continuity of the supply conduit of the large chamber of the first drive member; said two-way distributor including means for adjusting its position combined with means for adjusting the position of the first and second main distributors, whereby, when the first and second main distributors are placed in their first position, or in their second position, the two-way distributor is correspondingly placed in its first or in its second position, respectively.

2. A device for controlling at least first and second fluid-controlled drive members wherein the first drive member is double-acting and has separate small and large chambers of unequal useful sections, including:

first and second main distributors respectively associated with said first and second drive members, first and second supply conduits each respectively connecting one of the said small and large chambers of the first drive member to the first main distributor, at least one main source of pressurized fluid, a plurality of conduits connecting said main source to each distributor, said first distributor being movable to first, second, and third positions, in which in said first position the small chamber of the first drive member communicates with the main source associated therewith, in the second position the two chambers of said first drive member are isolated, and in the third position the large chamber communicates with said main source, said second drive member having at least one chamber, a supply conduit connecting said one chamber to the second main distributor, said second main distributor being movable to at least first and second positions respectively placing said chamber of the second drive member in communication with said main source and isolating that chamber from said main source, a communication conduit connecting the first and second supply conduits of the first drive member and non-return valve means disposed in said communication conduit for allowing the passage through the communication conduit of fluid only from the small chamber towards the large chamber of this first drive member in response to extremely low pressure differentials, and preventing passage of fluid from the large chamber towards the small chamber of the first drive member through the communication conduit, and a two-way distributor disposed in the supply conduit of the large chamber of the first drive member and connected, via a by-pass conduit to the supply conduit of said chamber of the second drive member, said two-way distributor being movable between first and second positions and interrupting, in its first position, said supply conduit of the large chamber of the first drive member, placing that part of the supply conduit connected to said large chamber in communication with the by-pass conduit and ensuring, in its second position, the continuity of the supply conduit of the large chamber of the first drive member, said two-way distributor including means for adjusting its position combined with means for adjusting the position of the first and second main distributors, whereby, when the first and second main distributors are placed in their first position, or in their second position, the two-way distributor is accordingly-placed in its first or in its second position, respectively.

3. The control device as defined in either claim 1 or claim 2, wherein said non-return valve is responsive to pressure differentials of less than about 5 bars.

4. In a device for controlling at least first and second fluid-controlled drive members, at least said first of which is double acting and has two separate chambers of unequal useful section, to wit, a smaller chamber and a larger chamber, comprising at least a first and second main distributor respectively associated with the first and second drive members, first and second supply conduits each respectively connecting the larger and smaller chambers of said first drive member to the first main distributor, main source means providing pressurizing fluid, connection conduits connecting said main source means to each said distributor, said first distributor having first, second, and third positions, in which, respectively, the smaller chamber of the first drive member communicates with the main source means, the smaller and larger chambers of said first drive member are isolated, and said larger chamber communicates with its associated main source means, said second drive member having at least one chamber, a third supply conduit connecting said at least one chamber of the second drive member to said second main distributor, said second main distributor having at least first and second positions, respectively, placing said one chamber of the second drive member in communication with its associated main source means, and isolating said one chamber from such main source means, a communication conduit connecting the larger and smaller chambers of said first drive member, non-return valve means disposed in said communication conduit for allowing the passage of the fluid only from the smaller chamber toward the larger chamber of the first drive member; characterized in that, in the first position of said first main distributor, the latter places the first supply conduit in communication with a fluid evacuation conduit, the second supply conduit is free of any substantial impedance to the flow of the fluid therethrough, said first main distributor is positionable in its first, second and third positions independent of the position of said second main distributor, and said second main distributor is positionable in its at least first and second positions independent of the position of said first main distributor, and further characterized in that a bypass conduit is connected to the larger chamber of the first drive member and to said one chamber of the second drive member; at least one connecting distributor is disposed on said bypass conduit to separate the bypass conduit into two parts, the connecting distributor having at least two positions in a first of which it places the two parts of the bypass conduit in communication with each other and in a second of which it isolates the two parts from each other; the connecting distributor including a position adjusting device which is combined with like position adjusting devices included in the first and second main distributors, so that there is simultaneous positioning of the distributors in their respective first and second positions.

5. A control device according to claim 4, wherein said first and second drive members are connected in one of a parallel configuration and an independent configuration, in which said bypass conduit is at least partly separate from said first and second supply conduits, and said connection distributor is separate from said first and second main distributors.

6. A control device according to claim 4 or claim 5, further comprising a two position selector disposed in the communication conduit and having a first, closed position completing said communication conduit and a second, open position blocking said communication conduit.

* * * * *